US008800904B2

(12) United States Patent
Belotserkovskiy

(10) Patent No.: US 8,800,904 B2
(45) Date of Patent: Aug. 12, 2014

(54) CONE CRUSHER

(75) Inventor: Konstantin Belotserkovskiy, Malmö (SE)

(73) Assignee: Sandvik Intellectual Property AB, Sandviken (SE)

( * ) Notice: Subject to any disclaimer, the term of this patent is extended or adjusted under 35 U.S.C. 154(b) by 437 days.

(21) Appl. No.: 13/165,841

(22) Filed: Jun. 22, 2011

(65) Prior Publication Data

US 2012/0006923 A1 Jan. 12, 2012

(30) Foreign Application Priority Data

Jul. 9, 2010 (SE) ..... 1050771

(51) Int. Cl.
*B02C 2/04* (2006.01)

(52) U.S. Cl.
USPC ..... 241/207; 241/30

(58) Field of Classification Search
USPC ..... 241/207
See application file for complete search history.

(56) References Cited

U.S. PATENT DOCUMENTS 1,553,333 A 9/1925 Sholl et al.
1,799,476 A * 4/1931 Newhouse ..... 241/209
1,936,728 A 11/1933 McCaskell
3,809,324 A * 5/1974 Cook ..... 241/210
3,908,916 A * 9/1975 Klushantsev et al. ..... 241/213
4,073,446 A * 2/1978 Rundkvist et al. ..... 241/207
4,463,908 A * 8/1984 Ivanov et al. ..... 241/207
4,566,638 A * 1/1986 Lundin et al. ..... 241/37
5,950,939 A * 9/1999 Drinkwater et al. ..... 241/30
6,446,892 B1 * 9/2002 Fasoli et al. ..... 241/207
7,048,214 B2 * 5/2006 Johnson et al. ..... 241/65

FOREIGN PATENT DOCUMENTS

RU 2 174 445 10/2001
SU 1351660 A1 11/1987

OTHER PUBLICATIONS

International Search Report for PCT/SE2011/050608, dated Oct. 12, 2011.

* cited by examiner

*Primary Examiner* — Shelley Self
*Assistant Examiner* — Homer Boyer
(74) *Attorney, Agent, or Firm* — Morgan, Lewis & Bockius LLP

(57) ABSTRACT

An inertia cone crusher, including an outer crushing shell and an inner crushing shell forming between them a crushing chamber, the inner crushing shell being supported on a crushing head which is attached on a crushing shaft which is rotatable in a sleeve, an unbalance weight being attached to the sleeve, a vertical drive shaft being connected to the sleeve for rotating the sleeve, the drive shaft being supported by a drive shaft bearing, and a first counterbalance weight and a second counterbalance weight, the first counterbalance weight being attached to the drive shaft in a position located below the drive shaft bearing, the second counterbalance weight being attached to the drive shaft in a position located above the drive shaft bearing.

18 Claims, 2 Drawing Sheets

II - II

CONE CRUSHER

This application claims priority under 35 U.S.C. §119 to Swedish Patent Application No. 1050771-3, filed on Jul. 9, 2010, which is incorporated by reference herein in its entirety.

FIELD OF THE INVENTION

The present invention relates generally to an inertia cone crusher including an outer crushing shell and an inner crushing shell forming between them a crushing chamber, the inner crushing shell being supported on a crushing head which is attached on a crushing shaft which is rotatable in a sleeve, an unbalance weight being attached to the sleeve, a vertical drive shaft being connected to the sleeve for rotating the same, the drive shaft being supported by a drive shaft bearing. The present invention further relates generally to a method of balancing an inertia cone crusher.

BACKGROUND OF THE INVENTION

An inertia cone crusher may be utilized for efficient crushing of material, such as stone, ore, etc. into smaller sizes. An example of an inertia cone crusher can be found in RU 2 174 445. In such an inertia cone crusher, material is crushed between an outer crushing shell, which is mounted in a frame, and an inner crushing shell, which is mounted on a crushing head which is supported on a spherical bearing. The crushing head is mounted on a crushing shaft. An unbalance weight is arranged on a cylindrical sleeve encircling the crushing shaft. The cylindrical sleeve is, via a drive shaft, connected to a pulley. A motor is operative for rotating the pulley, and, hence, the cylindrical sleeve. Such rotation causes the unbalance weight to rotate and to swing to the side, causing the crushing shaft, the crushing head, and the inner crushing shell to gyrate and to crush material that is fed to a crushing chamber formed between the inner and outer crushing shells.

SUMMARY OF THE INVENTION

An object of the invention to provide an inertia cone crusher with improved durability, compared to crushers of the prior art.

In an embodiment, the invention provides an inertia cone crusher, including an outer crushing shell and an inner crushing shell forming between them a crushing chamber, the inner crushing shell being supported on a crushing head which is attached on a crushing shaft which is rotatable in a sleeve, an unbalance weight being attached to the sleeve, a vertical drive shaft being connected to the sleeve for rotating the sleeve, the drive shaft being supported by a drive shaft bearing, and a first counterbalance weight and a second counterbalance weight, the first counterbalance weight being attached to the drive shaft in a position located below the drive shaft bearing, the second counterbalance weight being attached to the drive shaft in a position located above the drive shaft bearing.

An advantage of this crusher is that with first and second counterbalance weights arranged in the manner described, the load on the drive shaft bearing will be reduced, and the durability of the drive shaft bearing will be improved compared to the prior art.

According to one embodiment, the first and second counterbalance weights are attached to the same vertical side of the drive shaft. An advantage of this embodiment is that the load on the drive shaft bearing is further reduced, leading to a further improved durability of the drive shaft.

According to one embodiment, the second counterbalance weight is mounted on a rigid portion of the drive shaft. An advantage of this embodiment is that the second counterbalance weight does not swing to the side during crusher operation, such that the durability of moving parts, such as a ball spindle, is improved.

According to one embodiment, the moment of inertia of the unbalance weight is no more than 10 times the sum of the moments of inertia of the first and second counterbalance weights. An advantage of this embodiment is that the net centrifugal force acting on the crusher during crusher operation will be rather limited, which decreases the vibration and improves the durability of the crusher. If the moment of inertia of the unbalance weight would be more than 10 times the sum of the moments of inertia of the first and second counterbalance weights, the crusher would be exposed to extensive vibrations, requiring either a very heavy crusher frame to dampen such vibrations, or a reduced crushing capacity.

According to one embodiment, the moment of inertia of the unbalance weight is 1 to 10 times the sum of the moments of inertia of the first and second counterbalance weights. If the moment of inertia of the unbalance weight would be less than the sum of the moments of inertia of the first and second counterbalance weights, the crusher would be less efficient.

According to one embodiment, a moment of inertia of the first counterbalance weight is within +/−30% of the moment of inertia of the second counterbalance weight. An advantage of this embodiment is that a limited, or no, bending force will act on drive shaft bearing during operation of the crusher. This will further increase the durability of the drive shaft bearing.

A further object of the present invention is to provide a method of balancing an inertia cone crusher to improve the durability of the crusher compared to crushers of the prior art.

In another embodiment, the invention provides a method of balancing an inertia cone crusher, the cone crusher including an outer crushing shell and an inner crushing shell forming between them a crushing chamber, the inner crushing shell being supported on a crushing head which is attached on a crushing shaft which is rotatable in a sleeve, an unbalance weight being attached to the sleeve, a vertical drive shaft being connected to the sleeve for rotating the sleeve, and the drive shaft being supported by a drive shaft bearing. The method includes attaching a first counterbalance weight to the drive shaft in a position located below the drive shaft bearing, and attaching a second counterbalance weight to the drive shaft in a position located above the drive shaft bearing.

An advantage of this method is that the durability of the drive shaft bearing is improved, since bending forces are reduced.

According to one embodiment, the method further includes attaching the first and second counterbalance weights to the same vertical side of the drive shaft. An advantage of this embodiment is that the load on the drive shaft bearing is further reduced, hence improving the durability of the drive shaft.

According to one embodiment, the method further includes attaching the first and second counterbalance weights to a vertical side of the drive shaft which is different from that vertical side of the sleeve on which the unbalance weight is attached. An advantage of this embodiment is that the inertia cone crusher is even better balanced, hence further reducing the vibrations generated during operation of the crusher.

According to one embodiment, the second counterbalance weight is prevented from being displaced from the central axis of the drive shaft during operation of the crusher.

According to one embodiment, the amount of the centrifugal force caused by the first counterbalance weight and acting on the drive shaft below the drive shaft bearing is within +/−30% of the amount of the centrifugal force caused by the second counterbalance weight and acting on the drive shaft above the drive shaft bearing. An advantage of this embodiment is that the crusher becomes well balanced, such that vibrations are minimized. A further advantage is that the durability of the drive shaft bearing is further improved.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Figure 1:
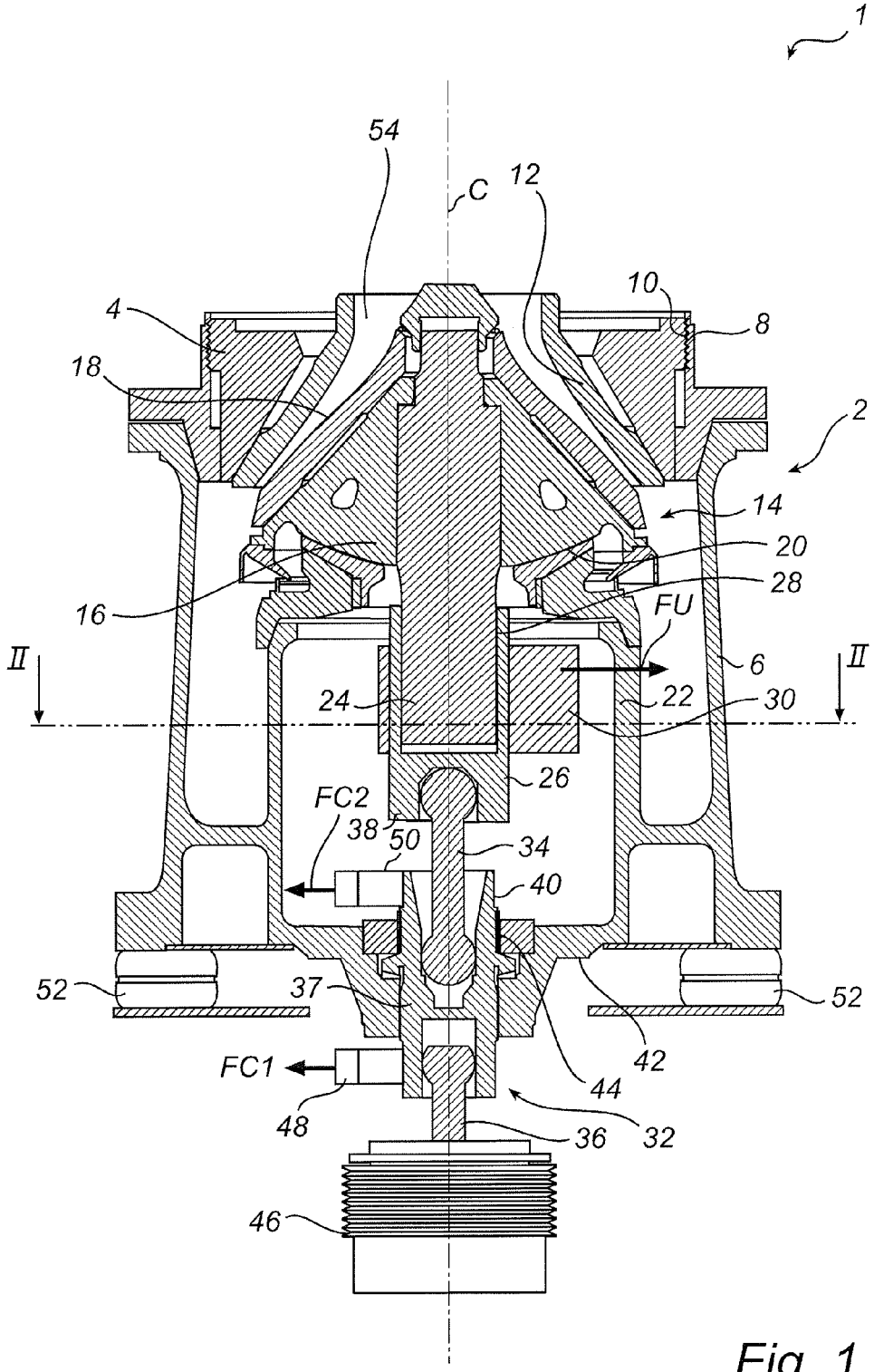
FIG. 1 is a schematic side view, in cross-section, of an inertia cone crusher.

FIG. 1 illustrates an inertia cone crusher 1 in accordance with one embodiment of the present invention. The inertia cone crusher 1 includes a crusher frame 2 in which the various parts of the crusher 1 are mounted. The crusher frame 2 includes an upper frame portion 4, and a lower frame portion 6. The upper frame portion 4 has the form of a bowl and is provided with an outer thread 10 which co-operates with an inner thread 8 of the lower frame portion 6. The upper frame portion 4 supports, on the inside thereof, an outer crushing shell 12. The outer crushing shell 12 is a wear part which may be made from, for example, a manganese steel.

The lower frame portion 6 supports an inner crushing shell arrangement 14. The inner crushing shell arrangement 14 includes a crushing head 16, which has the form of a cone and which supports an inner crushing shell 18, which is a wear part which may be made from, for example, a manganese steel. The crushing head 16 rests on a spherical bearing 20, which is supported on an inner cylindrical portion 22 of the lower frame portion 6.

The crushing head 16 is mounted on a crushing shaft 24. At a lower end thereof, the crushing shaft 24 is encircled by a cylindrical sleeve 26. The cylindrical sleeve 26 is provided with an inner cylindrical bearing 28 making it possible for the cylindrical sleeve 26 to rotate around the crushing shaft 24.

An unbalance weight 30 is mounted on one side of the cylindrical sleeve 26. At its lower end the cylindrical sleeve 26 is connected to a vertical drive shaft 32. The drive shaft 32 includes a ball spindle 34, a pulley shaft 36, an intermediate shaft 37 connecting the ball spindle 34 to the pulley shaft 36, an upper connector portion 38 which connects the ball spindle 34 to the cylindrical sleeve 26, and a lower connector portion 40 which is arranged on the intermediate shaft 37 and which connects the ball spindle 34 to the intermediate shaft 37. The two connector portions 38, 40 are connected to the ball spindle 34 in a non-rotating manner, such that rotational movement can be transferred from the pulley shaft 36 to the cylindrical sleeve 26 via the intermediate shaft 37 and the ball spindle 34. A bottom portion 42 of the lower frame portion 6 includes a vertical cylindrical drive shaft bearing 44 in which the vertical drive shaft 32 is supported. As depicted in FIG. 1, the drive shaft bearing 44 is arranged around the intermediate shaft 37 of the drive shaft 32, the intermediate shaft 37 extending vertically through the drive shaft bearing 44.

A pulley 46 is mounted on a low vibrating part (not shown) of the crusher 1 and is connected to the pulley shaft 36, below the drive shaft bearing 44. A motor (not shown) may be connected via, for example, belts or gear wheels, to the pulley 46. According to one alternative embodiment the motor may be connected directly to the pulley shaft 36.

The drive shaft 32 is provided with a first counterbalance weight 48, and a second counterbalance weight 50. As is illustrated in FIG. 1, the first and second counterbalance weights 48, 50 are located on the same vertical side, the left side as seen in FIG. 1, of the drive shaft 32.

The first counterbalance weight 48 is arranged below the bearing 44, which means that the first counterbalance weight 48 is also located below the bottom portion 42 of the lower frame portion 6. In the embodiment illustrated in FIG. 1, the first counterbalance weight 48 is mounted on the intermediate shaft 37, just below the bearing 44.

The second counterbalance weight 50 is arranged above the bearing 44, which means that the second counterbalance weight 50 is also located above the bottom portion 42 of the lower frame portion 6. The second counterbalance weight 50 is, in the embodiment illustrated in FIG. 1, mounted on the intermediate shaft 37 of the drive shaft 32, and more precisely on the lower connector portion 40 which is integrated with the intermediate shaft 37. Hence, the second counterbalance weight 50 is mounted on a rigid portion of the drive shaft 32, i.e., a portion, being the lower connector portion 40 of the intermediate shaft 37, which does not swing to the side when the crusher 1 is in operation. Thus, the second counterbalance weight 50 is prevented from being displaced from the central axis C of rotation of the drive shaft 32, which central axis coincides with the central axis C of the crusher 1, during operation of the crusher 1.

The crusher 1 may be suspended on springs 52 to dampen vibrations occurring during the crushing action.

The outer and inner crushing shells 12, 18 form between them a crushing chamber 54 to which material that is to be crushed is supplied. The discharge opening of the crushing chamber 54, and thereby the crushing capacity, can be adjusted by turning the upper frame portion 4, by the threads 8,10, such that the distance between the shells 12, 18 is adjusted.

When the crusher 1 is in operation the drive shaft 32 is rotated by the not shown motor. The rotation of the drive shaft 32 causes the sleeve 26 to rotate and swing outwards by the unbalance weight 30, displacing the unbalance weight 30 further away from the central axis C of the crusher 1, in response to the centrifugal force to which the unbalance weight 30 is exposed. Such displacement of the unbalance weight 30 and of the cylindrical sleeve 26 to which the unbalance weight 30 is attached is allowed due to the ball spindle 34 and to the fact that the sleeve 26 may slide somewhat, due to the cylindrical bearing 28, in the vertical direction along the crushing shaft 24. The combined rotation and swinging of the cylindrical sleeve 26 with unbalance weight 30 mounted thereon causes an inclination of the crushing shaft 24, and makes the crushing shaft 24 gyrate, such that material is crushed between the outer and inner crushing shells 12,18 forming between them the crushing chamber 54.

Figure 2:
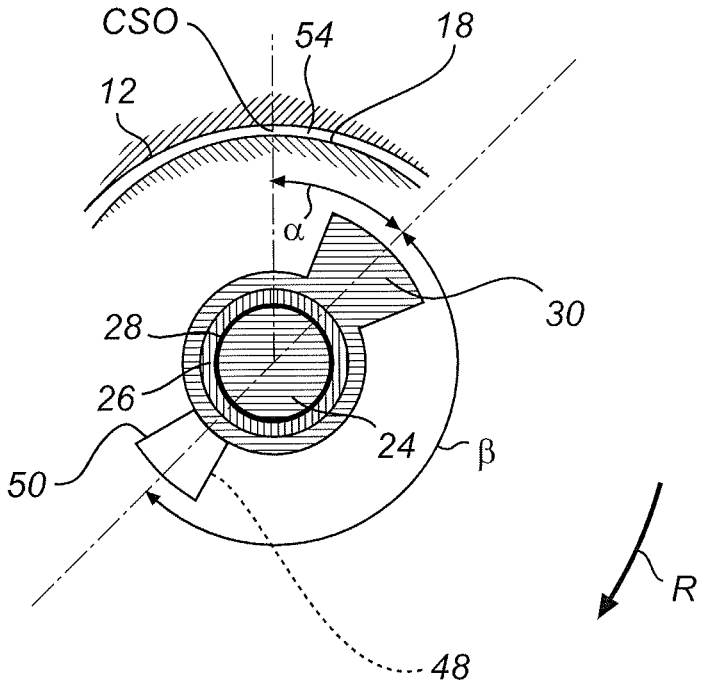
FIG. 2 is a schematic top view, in cross-section, of a crushing shaft as seen in the direction of arrows II-II of FIG. 1.

FIG. 2 illustrates the crushing shaft 24 as seen in the direction of arrows II-II of FIG. 1, i.e. as seen from above and in cross-section, when the crusher 1 is in operation. In FIG. 2, the direction of rotation of the sleeve 26, such rotation being induced by the not shown motor rotating the pulley 46 illustrated in FIG. 1, is clock-wise, as illustrated by an arrow R.

That position in the crushing chamber 54 at which the distance, at a specific time, between the outer crushing shell 12 and the inner crushing shell 18 is the smallest could be called closed side opening, denoted CSO in FIG. 2. The not shown motor will cause, via the pulley 46 and the drive shaft 32, the sleeve 26 and the unbalance weight 30 to rotate, which will cause the position of the CSO to rotate, clock-wise, at the same revolutions per minute (rpm) as the sleeve 26. On the instance illustrated in FIG. 2, the CSO is at the top of the figure, i.e., at twelve o'clock. As can be seen from FIG. 2, the corresponding position of the unbalance weight 30 is about between one and two o'clock. Hence, the unbalance weight 30 runs ahead of the CSO, and with an angle α between the position of the unbalance weight 30 and the position of the CSO of about 45°. The angle α between the position of the unbalance weight 30 and the position of the CSO will vary depending on the weight of the unbalance weight 30, and the rpm at which the unbalance weight 30 is rotated. Typically, the angle α will be about 10° to 90°. The first and second counter balance weights 48, 50, of which the first-mentioned is hidden by the last-mentioned in the illustration of FIG. 2, are preferably arranged on the same vertical side of the drive shaft 32, the latter being hidden in FIG. 2. Hence, in the top view perspective of FIG. 2, the second counterbalance weight 50 is located vertically above the first counterbalance weight 48 and hides the same. The counterbalance weights 48, 50 are connected to the sleeve 26, via the ball spindle 34 and the intermediate shaft 37, as is illustrated in FIG. 1, and, hence, rotate at the same rpm as the unbalance weight 30. As is illustrated in FIG. 2, the first and second counterbalance weights 48, 50 are placed on a different vertical side of the shaft 24, compared to the unbalance weight 30. In the instance illustrated in FIG. 2, the first and second counterbalance weights 48, 50 have a position which could be referred to as between seven and eight o'clock. Hence, an angle β between the position of the unbalance weight 30 and the position of the counterbalance weights 48, 50 is about 180°. The angle β may be adjusted depending on the weight of the unbalance weight 30, the rpm at which the unbalance weight 30 is rotated, and the type and amount of material that is to be crushed. Typically, the angle β would be set to about 120 to 200°. To account for various materials and rpm, the angle β may be adjustable, by for example turning the unbalance weight 30 around the sleeve 26 to a suitable position, i.e., a suitable angle β, in relation to the counterbalance weights 48, 50.

The centrifugal force acting on the unbalance weight 30, illustrated by an arrow FU in FIG. 1, tends to move the entire crusher 1 in the direction of the arrow FU. The centrifugal force FU acting on the unbalance weight 30 when the crusher 1 is operating is counteracted by a centrifugal force FC1 acting on the first counterbalance weight 48 plus a centrifugal force FC2 acting on the second counterbalance weight 50. Hence, the net centrifugal force acting on the crusher 1 will be reduced.

The forces influencing the crusher 1 during operation can be evaluated by calculating the moment of inertia. The moment of inertia of a solid body rotating around an axis, in this case the central axis C of rotation of the drive shaft 32, can be calculated, for example, by the following equation for a point mass:

$$I=m\times r^2 \qquad \text{[eq 1.1]}$$

where:

m=mass of the body [unit: kg]

r=distance between point load and axis of rotation [unit: m]

I=moment of inertia [unit: $kgm^2$]

For non-point loads other equations can be used for calculating the moment of inertia. For example, a dimensionless constant c, called the inertial constant and being related to the shape of the load, could be multiplied with mass and length to arrive at the correct moment of inertia I. Hence:

$$I=c\times m\times L^2 \qquad \text{[eq. 1.2]}$$

where:

c=the dimensionless constant that varies with the shape of the object in consideration [unit: -]

m=the mass of the object [unit: kg]

L=a length dimension, correlated to c [unit: m]

I=moment of inertia [unit: $kgm^2$]

Hence, it is possible to calculate the moment of inertia, I, of each of the unbalance weight 30, the first counterbalance weight 48 and the second counterbalance weight 50 based on the respective mass m, the respective L and the respective inertial constant c. The respective moments of inertia could be denoted $I_{30}$, for the moment of inertia of the unbalance weight 30, $I_{48}$ for the moment of inertia of the first counterbalance weight 48, and $I_{50}$ for the moment of inertia of the second counterbalance weight 50.

Preferably the moment of inertia of the unbalance weight 30 is no more than 10 times the sum of the moments of inertia of the first and second counterbalance weights 48, 50. Hence, $I_{30}<=10\times(I_{48}+I_{50})$. More preferably the moment of inertia of the unbalance weight 30 is 1 to 10 times the sum of the moments of inertia of the first and second counterbalance weights 48, 50. Hence, the moment of inertia $I_{30}$ of the unbalance weight 30 should fulfill the following equation: $1\times(I_{48}+I_{50})<=I_{30}<=10\times(I_{48}+I_{50})$.

The amount of the centrifugal force FC1 acting on the first counterbalance weight 48 when the crusher 1 is operating is preferably rather similar to the amount of the centrifugal force FC2 acting on the second counterbalance weight 50. If FC1 is rather similar to FC2, for example FC1=FC2, there will be a very limited bending force exerted on the drive shaft bearing 44. With a low bending force exerted on the drive shaft bearing 44 it will be possible to arrange heavy counterbalance weights 48, 50 without exposing the drive shaft bearing 44 to forces that would significantly reduce the life thereof.

The centrifugal force FC1, FC2 of each counterbalance weight 48, 50 can be calculated according to:

$$FC=m*v^2/r \qquad \text{[eq. 1.3]}$$

where:

FC=the centrifugal force [unit: N]

m=the mass of the body [unit: kg]

v=the velocity in the pathway [unit: m/s]

r=the distance from axis of rotation to the center of mass [unit: m]

In accordance with one preferred embodiment, the amount of the centrifugal force FC1 acting on drive shaft 32 below the drive shaft bearing 44 when the crusher 1 is in operation is within +/−30%, more preferably within +/−20%, of the amount of the centrifugal force FC2 acting on drive shaft 32 above the drive shaft bearing 44. Hence, for example, if the centrifugal force FC2 acting on drive shaft 32 above the drive shaft bearing 44 is 50 kilo Newton (kN), then the centrifugal force FC1 acting on drive shaft 32 below the drive shaft bearing 44 should preferably be within the range 35 to 65 kN, more preferably 40 to 60 kN. Most preferably the forces FC1 and FC2 are substantially equal, since that gives the lowest bending load on the drive shaft bearing 44. The centrifugal force FU of the unbalance weight 30 is preferably 1 to 10 times the sum of the centrifugal forces FC1 and FC2 when the crusher 1 is in operation, i.e. 1×(FC1+FC2)<=FU<=10×(FC1+FC2).

Furthermore, the moment of inertia, in $kgm^2$, of the first counterbalance weight 48 is preferably within +/−30% of the moment of inertia, in $kgm^2$, of the second counterbalance weight 50.

Hereinbefore, it has been described that the entire unbalance acting on crushing shaft 24 comes from unbalance weight 30. It will be appreciated that there might be further, usually small, unbalance weights, and even small counterbalance weights, attached to cylindrical sleeve 26, and also other items, such as unbalance weight fastening means, that are not absolutely symmetric around cylindrical sleeve 26. When calculating the centrifugal force FU, or the moment of inertia I, the effect of such other unbalances are preferably also taken into account, such that the net centrifugal force FU acting on cylindrical sleeve 26 may be calculated. In a similar manner there might be further, usually small, counterbalance weights, or even unbalance weights, arranged below and/or above the drive shaft bearing 44, including devices for mounting the counterbalance weights 48, 50 to the drive shaft 32, that are not absolutely symmetric around drive shaft 32. When calculating the centrifugal forces FC1 and FC2, or the moment of inertia I, the effect of such other counterbalances are preferably also taken into account, such that the net centrifugal forces FC1 and FC2 acting on drive shaft 32, and in particular on drive shaft bearing 44, may be calculated.

While the invention has been disclosed with reference to certain preferred embodiments, numerous modifications, alterations, and changes to the described embodiments are possible without departing from the sphere and scope of the invention, as defined in the appended claims and their equivalents thereof. For example, hereinbefore it has been described that the unbalance weight 30 and the counterbalance weights 48, 50 each include one weight. It will be appreciated that any one of the unbalance weight 30, the first counterbalance weight 48 and the second counterbalance weight 50 may include several weight segments and/or several sub-weights located in various positions. Accordingly, it is intended that the invention not be limited to the described embodiments, but that it have the full scope defined by the language of the following claims.

What is claimed is:

1. An inertia cone crusher, comprising:

an outer crushing shell and an inner crushing shell forming between them a crushing chamber;

the inner crushing shell being supported on a crushing head which is attached on a crushing shaft which is rotatable in a sleeve;

an unbalance weight being attached to the sleeve;

a vertical drive shaft being connected to the sleeve for rotating the sleeve, the drive shaft being supported by a drive shaft bearing; and a first counterbalance weight and a second counterbalance weight, the first counterbalance weight being attached to the drive shaft in a position located below the drive shaft bearing, the second counterbalance weight being attached to the drive shaft in a position located above the drive shaft bearing.

2. The inertia cone crusher according to claim 1, wherein the first and second counterbalance weights are attached to a same vertical side of the drive shaft.

3. The inertia cone crusher according to claim 1, wherein the first and second counterbalance weights are attached to a side of the drive shaft which is different from that side of the sleeve on which the unbalance weight is attached.

4. The inertia cone crusher according to claim 1, wherein the second counterbalance weight is mounted on a rigid portion of the drive shaft.

5. The inertia cone crusher according to claim 1, wherein a moment of inertia of the unbalance weight is no more than 10 times the sum of the moments of inertia of the first and second counterbalance weights.

6. The inertia cone crusher according to claim 1, wherein a moment of inertia of the unbalance weight is 1 to 10 times the sum of the moments of inertia of the first and second counterbalance weights.

7. The inertia cone crusher according to claim 1, wherein a moment of inertia of the first counterbalance weight is within +/−30% of the moment of inertia of the second counterbalance weight.

8. A method of balancing an inertia cone crusher, the cone crusher including an outer crushing shell and an inner crushing shell forming between them a crushing chamber, the inner crushing shell being supported on a crushing head which is attached on a crushing shaft which is rotatable in a sleeve, an unbalance weight being attached to the sleeve, a vertical drive shaft being connected to the sleeve for rotating the sleeve, and the drive shaft being supported by a drive shaft bearing, the method comprising:

attaching a first counterbalance weight to the drive shaft in a position located below the drive shaft bearing, and attaching a second counterbalance weight to the drive shaft in a position located above the drive shaft bearing.

9. The method according to claim 8, further comprising attaching the first and second counterbalance weights to a same vertical side of the drive shaft.

10. The method according to claim 8, further comprising attaching the first and second counterbalance weights to a side of the drive shaft which is different from that side of the sleeve on which the unbalance weight is attached.

11. The method according to claim 8, wherein the second counterbalance weight is prevented from being displaced from the central axis of the drive shaft during operation of the crusher.

12. The method according to claim 8, wherein the amount of the centrifugal force caused by the first counterbalance weight and acting on the drive shaft below the drive shaft bearing is within +/−30% of the amount of the centrifugal force caused by the second counterbalance weight and acting on the drive shaft above the drive shaft bearing.

13. The method according to claim 8, wherein the vertical drive shaft includes a ball spindle, a pulley shaft, an intermediate shaft connecting the ball spindle to the pulley shaft, and the sleeve, and wherein an upper connector portion of the sleeve is connected to the ball spindle and a lower connector portion of the intermediate shaft is connected to the ball spindle, and wherein rotational movement is transferable from the pulley shaft to the cylindrical sleeve via the intermediate shaft and the ball spindle.

14. The method according to claim 8, wherein, during rotation of the vertical drive shaft, the sleeve is swingable outward relative to a central axis by operation of the unbalance weight in response to centrifugal force.

15. The method according to claim 8, wherein the sleeve is slideable in the vertical direction along the crushing shaft.

16. The inertia cone crusher according to claim 1, wherein the vertical drive shaft includes a ball spindle, a pulley shaft, an intermediate shaft connecting the ball spindle to the pulley shaft, and the sleeve, and wherein an upper connector portion of the sleeve is connected to the ball spindle and a lower connector portion of the intermediate shaft is connected to the ball spindle to transfer rotational movement from the pulley shaft to the cylindrical sleeve via the intermediate shaft and the ball spindle.

17. The inertia cone crusher according to claim 1, wherein, during rotation of the vertical drive shaft, the sleeve is swingable outward relative to the central axis by operation of the unbalance weight in response to centrifugal force.

18. The inertia cone crusher according to claim 1, wherein the sleeve is slideable in the vertical direction along the crushing shaft.

* * * * *